US005333592A

United States Patent [19]

Benedikt et al.

[11] Patent Number: 5,333,592

[45] Date of Patent: Aug. 2, 1994

[54] IGNITION COIL FOR IGNITION SYSTEMS IN COMBUSTION ENGINES

[75] Inventors: Walter Benedikt, Kornwestheim; Dieter Betz, Vaihingen/Enz; Werner Grewe, Leonberg; Gerhard Haist, Freiberg/Neckar, all of Fed. Rep. of Germany

[73] Assignee: Robert Bosch GmbH, Stuttgart, Fed. Rep. of Germany

[21] Appl. No.: 50,453

[22] PCT Filed: Sep. 12, 1992

[86] PCT No.: PCT/DE92/00773

§ 371 Date: May 13, 1993

§ 102(e) Date: May 13, 1993

[87] PCT Pub. No.: WO93/09345

PCT Pub. Date: May 13, 1993

[30] Foreign Application Priority Data

Nov. 5, 1991 [DE] Fed. Rep. of Germany ..... 9113753

[51] Int. Cl.[5] ..... F02P 11/00

[52] U.S. Cl. ..... 123/634

[58] Field of Search ..... 123/634, 635, 169 Ph, 123/169 PA, 90.38; 336/83, 84 M, 107, 192, 196; 174/35 SM

[56] References Cited

U.S. PATENT DOCUMENTS

| | | | |
|---|---|---|---|
| 4,514,712 | 4/1985 | McDougal | 336/196 |
| 4,751,430 | 6/1988 | Muller et al. | 315/57 |
| 4,893,105 | 1/1990 | Maeda et al. | 336/84 M |
| 4,903,674 | 2/1990 | Bassett et al. | 123/634 |
| 5,003,958 | 4/1991 | Yoneyama et al. | 123/635 |
| 5,101,803 | 4/1992 | Nakamura et al. | 123/634 |
| 5,146,906 | 9/1992 | Agatsuma | 123/634 |
| 5,170,767 | 12/1992 | Wada et al. | 123/633 |
| 5,237,982 | 8/1993 | Asakura et al. | 123/635 |
| 5,241,941 | 9/1993 | Hancock et al. | 123/634 |

FOREIGN PATENT DOCUMENTS

| | | | |
|---|---|---|---|
| 0445557 | 9/1991 | European Pat. Off. | 123/634 |
| 0454597 | 10/1991 | European Pat. Off. | 123/634 |
| 4125525 | 2/1992 | Fed. Rep. of Germany | 123/634 |

*Primary Examiner*—Raymond A. Nelli
*Attorney, Agent, or Firm*—Michael J. Striker

[57] ABSTRACT

An ignition coil for ignition systems of internal combustion engines of motor vehicles has at least one primary connection part connectable with a voltage source, at least one secondary connection part having at least one connection dome, a pin and a spark plug terminal connected with the pin and attachable to a spark plug mountable in a spark plug recess, and a centering sleeve adapted to the shape of the spark plug recess and allowing for movement clearance, and the centering sleeve is undetachably fastened to the spark plug terminal.

8 Claims, 1 Drawing Sheet

IGNITION COIL FOR IGNITION SYSTEMS IN COMBUSTION ENGINES

BACKGROUND OF THE INVENTION

The present invention relates to an ignition coil for ignition systems in combustion engines.

More particularly, it relates to an ignition coil with at least one secondary connection part.

Ignition coils having a sleeve-shaped secondary connection part which projects out of the housing of the ignition coil and conducts high voltage to the spark plug are known in general. These secondary connection parts have a connection dome and a spark plug terminal which is permanently coupled with the latter.

The location where the connection dome is coupled with the spark plug terminal is constructed in such a way that the spark plug terminal can be swiveled to a slight extent relative to the connection dome which rigidly projects from the housing of the ignition coil. This swiveling serves to compensate tolerances between the ignition coil which is fastened directly to the cylinder head and the spark plug which is fixed in a spark plug recess of the cylinder head of the internal combustion engine.

Since the spark plug recess, for purposes of mounting, has a greater inner diameter than the outer diameter of the spark plug or spark plug terminals connected with the ignition coil, it may happen in rare instances when mounting the ignition coil on the cylinder head that the spark plug terminal does not slide onto the spark plug, but instead enters the intermediate space between the wall of the spark plug recess and the spark plug. This faulty mounting is generally not detected during the initial operation of the internal combustion engine because, with the high voltage provided by the ignition coil, the improperly contacted spark plug receives a sufficient, though reduced, ignition voltage by spark-over or arcing.

However, the voltage which is transmitted in this way is not sufficient for generating an ignition spark at the defectively contacted spark plug under adverse operating conditions caused by weather and aging. This leads to misfiring and to emission of unburned fuel from the internal combustion engine, which must be prevented.

SUMMARY OF THE INVENTION

Accordingly, it is an object of the present invention to provide an ignition coil for ignition systems of internal combustion engines of motor vehicles, which avoids the disadvantages of the prior art.

In keeping with these objects and with others which will become apparent hereinafter, one feature of the present invention resides, briefly stated, in an ignition coil for ignition systems for internal combustion engines, in which a centering sleeve is provided and formed so that it is adapted to the shape of a spark plug recess of the internal combustion engine and allows for a movement clearance, and the centering sleeve is undetachably fastened to the spark plug terminal.

When the ignition coil is designed in accordance with the present invention, it has the advantage over the prior art that the above-mentioned shortcomings are satisfactorily prevented. For this purpose, a centering sleeve is permanently fastened to the spark plug terminal of the ignition coil. With an ignition coil supplemented in this way, it is ensured that the spark plug terminal penetrates into the spark plug recess centrically relative to the spark plug even when incorrectly mounted and a proper operation of the internal combustion engine is ensured via a reliable contact of the spark plug with the ignition coil even under adverse operating conditions.

In accordance with another advantageous feature of the present invention, the spark plug has an elastic bush forming its outer boundary, at which at least one bead is constructed, particularly a torus which can be brought into a locking position when a centering sleeve is slid onto the spark plug terminal so as to hold the centering sleeve in a positive engagement.

The bush can be slid over the connection dome of the secondary connection part accompanied by a radial widening when the spark plug terminal is coupled to the pin of the connection dome, and in doing so the torus is radially widened and this widening fixes the centering sleeve placed on the bush in a frictionally and positively locking engagement. Therefore, the centering sleeve can be undetachably arranged on the spark plug terminal.

In accordance with still another feature of the present invention, the outer surface area of the centering sleeve can be provided with at least one longitudinal slot. In this case, adequate ventilation of the spark plug recess is achieved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a partial section of an ignition coil with a contacted spark plug in accordance with the present invention.

DESCRIPTION OF PREFERRED EMBODIMENTS

Figure 1:
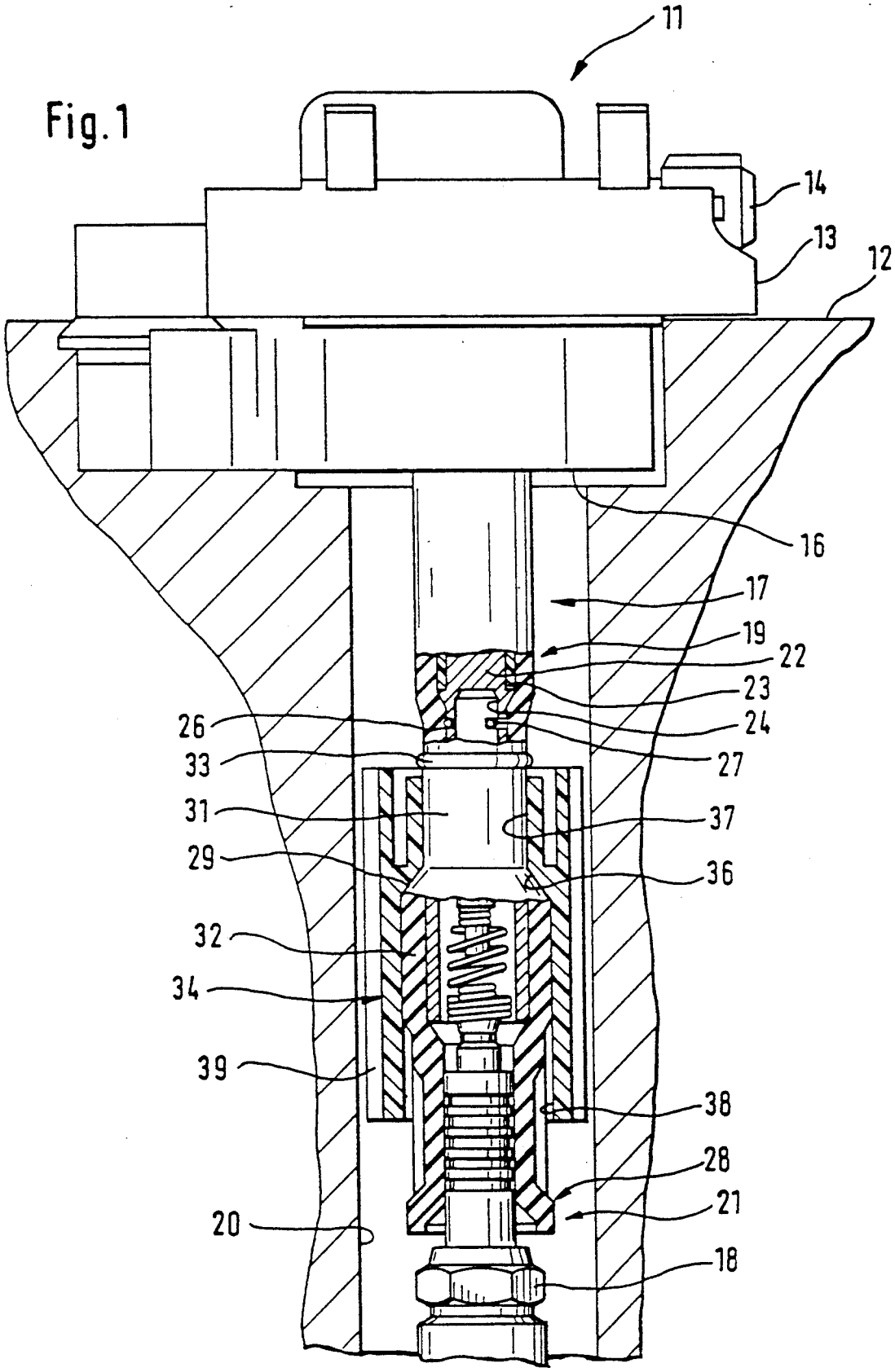

An ignition coil 11 for ignition systems of internal combustion engines for motor vehicles is fastened at the cylinder head 12 of an internal combustion engine in a manner not shown in more detail in the drawing.

The ignition coil 11 is extensively enclosed by a pot-shaped housing 13 of fiber-glass reinforced thermoplastic. In a known manner it contains a core of magnetically conductive material which is not shown in more detail. One leg of the core carries a primary winding and a secondary winding.

A primary connection part 14 is arranged at the housing 13, and the ignition coil 11 is connected via the latter with the voltage source of the motor vehicle.

Further, a sleeve-shaped secondary connection part 17 projects vertically with respect to a fill-in side 16 of the housing 13. This secondary connection part 17 forms the high-voltage output of the ignition coil 11 and is the means for contacting a spark plug 18 which is mounted in a spark plug recess 20 in the cylinder head 12.

The secondary connection part 17 is anchored in the ignition coil 11 which is completely filled with an electrically insulating sealing compound of epoxy resin. The compound hardens at the fill-in side 16 to close the pot-shaped housing 13 and securely encloses the secondary connection part 17 where it exits from the fill-in side 16.

The secondary connection part 17 which is constructed in two parts in this embodiment example has a connection dome 19 which is rigidly fixed in the ignition coil 11 and a spark plug terminal 21 which is coupled with the latter.

The connection dome 19 has a metal pin 22 which is enclosed virtually over its entire length by an insulator 23 of duroplastic. Only the end region of the pin 22 facing away from the ignition coil 11 is not insulated. The pin 22 has an axial pocket hole 24 and, at its circumference, an outer annular groove 26 which has a passage to the pocket hole 24 at one side and receives a retaining ring 27 which projects on one side through the passage into the pocket hole 24. A suitably shaped metallic counter-piece of the spark plug terminal 21 which is not shown in the drawing can be inserted into the pocket hole 24 so as to lock in a permanent manner with the retaining ring 27. This electrically conductive coupling between the connection dome 19 and the spark plug terminal 21 makes it possible for the spark plug terminal 21 to swivel slightly relative to the connection dome 19 which is rigidly connected with the ignition coil 11.

The connection dome 19, and accordingly also the end region of the pin 22, is surrounded by an insulating silicon-rubber bush 28 of the spark plug terminal 21 when the spark plug terminal 21 is coupled with the connection dome 19. The bush 28 surrounding the spark plug terminal 21 along with all of its contact parts for the connection dome 19 and for the spark plug 18, which contact parts are known in general and not described in more detail, is sleeve-shaped. It has a cylindrically stepped outer shape with a shoulder 29 which faces the ignition coil 11 and divides a first portion 31 from a second portion 32 of greater diameter.

The first portion 31 has an annular ring or torus 33 which is longitudinally off-center and faces the portion 32 of greater diameter. The torus 33 forms a locking means for a centering sleeve 34 which can be slid over the bush 28.

The centering sleeve 34 has a slightly conical outer shape and ends in a small diameter on one side and in a large diameter on the other side.

The inner shape of the centering sleeve 34 contains two cylindrical regions which are constructed substantially as stepped inner cylinders and connected by a conical inner shoulder 36, a first region 37 which terminates at the front with a large diameter and a second region 38 which has a greater inner diameter compared to the first region 37 and terminates at the front with a small diameter.

When mounting the centering sleeve 34 on the bush 28, the centering sleeve 34 is slid over the first portion 31 of the bush 28 with the second region 38 foremost. In so doing, the torus 33 of the bush 28 first arrives at the first region 37 of the centering sleeve 34, whose diameter is smaller than that of the torus 33 so as to constitute a pressing play or force clearance, until the inner shoulder 36 of the centering sleeve 34 strikes the shoulder 29 of the bush 28 and the front of the torus 33 comes to rest behind the first region 37 and locks the centering sleeve 34 in a positive engagement at the bush 28 in a springing manner.

The centering sleeve 34 which is fastened at the bush 28 in this manner is also fixed at the bush 28 in a frictional engagement in that the first portion 31 of the bush 28 is slid onto the connection dome 19 until the coupling between the pin 22 and the spark plug terminal 21 is effected. In so doing, the outer dimensioning of the insulator 29 effects a widening in diameter of the first portion 31 of the bush 28 which also includes the torus 33 so that the centering sleeve 34 is no longer detachable from the bush 28.

The ignition coil 11 which is supplemented by the centering sleeve 34 in this way can now be mounted on the cylinder head 12 in such a way that the spark plug terminal 21 always slides onto the spark plug 18 centrically, since the centering sleeve 34 guides the spark plug terminal 21 centrically into the spark plug recess 20 with its outer shape which is adapted to the inner geometry of the spark plug recess 20 while allowing for movement clearance.

The outer surface area of the centering sleeve 34 is provided with a plurality of longitudinal slots 39 for ventilation of the spark plug recess 20.

It is accordingly ensured that the ignition coil 11 is securely and functionally mounted on the cylinder head 12 even under unfavorable mounting conditions.

Alternatively, the centering sleeve 34 can also be used in a multiple-spark ignition coil which supplies a plurality of spark plugs 18 with ignition energy. In addition to the secondary connection part 17 described in the preceding, this multiple-spark ignition coil has additional secondary connection parts which are generally flexibly connected with the multiple-spark ignition coil. The mounting of these secondary connection parts 17 on the spark plugs is extensively trouble-free and by using centering sleeves 34 can be carried out faultlessly even when mounted by untrained persons.

It will be understood that each of the elements described above, or two or more together, may also find a useful application in other types of constructions differing from the types described above.

While the invention has been illustrated and described as embodied in an ignition coil for ignition systems of internal combustion engines of motor vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ignition coil for ignition systems of internal combustion engines of motor vehicles, comprising at least one primary connection part connectable with a voltage source; at least one secondary connection part having at least one connection dome, a pin and a spark plug terminal connected with said pin and attachable to a spark plug mountable in a spark plug recess; and a centering sleeve adapted to the shape of the spark plug recess and allowing for movement clearance, said centering sleeve being undetachably fastened to said spark plug terminal.

2. An ignition coil as defined in claim 1, wherein said spark plug terminal has an elastic bush which forms its outer boundary and is provided with at least one bead bringable into a locking position when said centering sleeve is slid onto said spark plug terminal so as to hold said centering sleeve in a positive engagement.

3. An ignition coil as defined in claim 2, wherein said bead of said elastic bush is formed as a torus.

4. An ignition coil as defined in claim 3, wherein said bush is slid over said connection dome accompanied by a radial widening when said spark plug terminal is coupled to said pin of said connection dome, and said torus is radially widened so as to fix said centering sleeve placed on said bush in a frictionally and positively locking engagement.

5. An ignition coil as defined in claim 1, wherein said centering sleeve has a shape corresponding to the shape of the spark plug recess and has outer dimensions which are smaller than inner dimensions of the spark plug recess by an amount allowing for the movement clearance.

6. An ignition coil as defined in claim 5, wherein said centering sleeve has a shape corresponding to a diameter of the spark plug recess.

7. An ignition coil as defined in claim 1, wherein said centering sleeve has an outer shape which is slightly conical and has a smaller diameter facing an end of the spark plug recess.

8. An ignition coil as defined in claim 1, wherein said centering sleeve has an outer surface area which is provided with at least one longitudinal slot so as to obtain ventilation of the spark plug recess.

* * * * *